US012448202B2

(12) United States Patent
Scheuber et al.

(10) Patent No.: US 12,448,202 B2
(45) Date of Patent: Oct. 21, 2025

(54) REFILLABLE DISPENSER CAN WITH REFILL VALVE AND OUTLET VALVE AND A BAG FOR RECEIVING AN ACTIVE SUBSTANCE

(71) Applicant: WÜRTH INTERNATIONAL AG, Chur (CH)

(72) Inventors: Michael Scheuber, Langenbrettach (DE); Herbert Reuther, Krautheim (DE)

(73) Assignee: WÜRTH INTERNATIONAL AG, Chur (CH)

( * ) Notice: Subject to any disclaimer, the term of this patent is extended or adjusted under 35 U.S.C. 154(b) by 37 days.

(21) Appl. No.: 18/566,384

(22) PCT Filed: May 4, 2022

(86) PCT No.: PCT/EP2022/061899
§ 371 (c)(1),
(2) Date: Dec. 1, 2023

(87) PCT Pub. No.: WO2022/253508
PCT Pub. Date: Dec. 8, 2022

(65) Prior Publication Data

US 2024/0246747 A1 Jul. 25, 2024

(30) Foreign Application Priority Data

Jun. 2, 2021 (DE) ..... 10 2021 114 340.3

(51) Int. Cl.
*B65D 83/42* (2006.01)
*B65D 83/32* (2006.01)
(Continued)

(52) U.S. Cl.
CPC ..... *B65D 83/425* (2013.01); *B65D 83/32* (2013.01); *B65D 83/384* (2013.01); *B65D 83/62* (2013.01)

(58) Field of Classification Search
CPC .... B65D 83/425; B65D 83/32; B65D 83/384; B65B 31/003
(Continued)

(56) References Cited

U.S. PATENT DOCUMENTS 5,645,113 A 7/1997 Humm et al.
8,844,584 B1 * 9/2014 Haley ..... B65B 3/26 141/3
(Continued)

FOREIGN PATENT DOCUMENTS

AU 6383698 A 7/1998
AU 713700 B2 12/1999
(Continued)

OTHER PUBLICATIONS

Japanese Office action for Application No. 2023-565559, dated Sep. 24, 2024, 6 pages.
(Continued)

*Primary Examiner* — Jason K Niesz
(74) *Attorney, Agent, or Firm* — Womble Bond Dickinson (US) LLP

(57) ABSTRACT

Refillable dispenser can for discharging an active substance, wherein the dispenser can comprises a deformable bag for receiving the active substance, a refill valve which is connected with the bag, for connecting with a refill station for refilling the bag with the active substance, and an outlet valve which is connected with the bag, for discharging the active substance out of the bag in a user-defined manner.

19 Claims, 5 Drawing Sheets

(51) Int. Cl.
*B65D 83/384* (2025.01)
*B65D 83/62* (2006.01)

(58) Field of Classification Search
USPC ..... 141/18, 2
See application file for complete search history.

(56) References Cited

U.S. PATENT DOCUMENTS

| | | | | |
|---|---|---|---|---|
| 8,884,584 | B1 | 11/2014 | Emori et al. | |
| 9,932,167 | B2 | 4/2018 | Ogata | |
| 2005/0040253 | A1 | 2/2005 | Thornton | |
| 2006/0162807 | A1* | 7/2006 | Mackenzie | B65D 83/42 141/20 |
| 2013/0327790 | A1 | 12/2013 | Ryan | |
| 2017/0361962 | A1* | 12/2017 | Abramowicz | B65D 83/38 |

FOREIGN PATENT DOCUMENTS

| | | | |
|---|---|---|---|
| FR | 2 959 729 | A1 | 11/2011 |
| JP | S63138979 | A | 6/1988 |
| JP | H07206057 | A | 8/1995 |
| RS | 60489 | B1 | 8/2020 |
| WO | 94/03380 | A1 | 2/1994 |
| WO | 2016/170684 | A1 | 10/2016 |
| WO | 2019039951 | A2 | 2/2019 |

OTHER PUBLICATIONS

German Search Report of DE 10 2021 114 340.3, Dec. 17, 2021, 5 pages.
International Search Report and Written Opinion of PCT/EP2022/061899, Sep. 21, 2022, 14 pages.
Chinese Office action for application No. 202280039407.8, dated Aug. 6, 2025, 18 pages.

* cited by examiner

REFILLABLE DISPENSER CAN WITH REFILL VALVE AND OUTLET VALVE AND A BAG FOR RECEIVING AN ACTIVE SUBSTANCE

CROSS-REFERENCE TO RELATED APPLICATIONS

This application is a national US phase of PCT/EP2022/061899, filed May 4, 2022, which claims the benefit of the filing date of the German Patent Application No. 10 2021 114 340.3 filed 2 Jun. 2021, the disclosure of which is hereby incorporated herein by reference.

TECHNICAL FIELD

The disclosure relates to a dispenser can, a refill arrangement, and a method for operating a refill station.

TECHNOLOGICAL BACKGROUND

Dispenser cans are known which are automatically refillable by a refill station. Such a known refill station is the REFILLO® mat station of the applicant Würth. This secure and economical system is based on the automatic refill of empty dispenser cans with an active substance and pressure air. This enables to fill dispenser cans with active substances from large containers (German: Großgebinden) (for example canisters or barrels). For this purpose, the dispenser cans for the individual active substances are pushed on the corresponding refill station. Then, a refill of the dispenser can with the active substance and pressure air in a pregiven ratio is performed. To exclude a confusion of the dispenser can and an assigned active substance, the can reception is mechanically encoded, such that only the correct dispenser can can be mechanically attached on the correct can reception. Thereby, only a mechanically fitting dispenser can can be used with the assigned refill station. A confusion of active substances and dispenser cans, which may be dangerous under certain circumstances, is therefore mechanically suppressed.

SUMMARY OF THE DISCLOSURE

There may be a need to provide a simply handable, resource-saving and operationally secure dispenser can for an active substance.

This need is met by the substance-matters with the features according to the independent patent claims. Further embodiments are shown in the dependent claims.

According to an embodiment of the present invention, a refillable dispenser can for discharging an active substance is provided, wherein the dispenser can comprises a deformable bag for receiving the active substance, a refill valve which is connected with the bag, for connecting with a refill station for refilling the bag with the active substance, and an outlet valve which is connected with the bag, for discharging (in particular spraying) the active substance out of the bag in a user-defined manner.

According to another embodiment of the present invention, a refill arrangement is provided which comprises a refill station with a receiving device for receiving a dispenser can which is to be refilled with an active substance and with a control unit for controlling the refill of the dispenser can with the active substance, and a dispenser can with the above-described features which is attachable or attached at the receiving device.

According to yet another embodiment of the present invention, a method for operating a refill station is provided, wherein the method comprises receiving a refill valve of a dispenser can with the above-described features which is to be refilled with an active substance at a receiving device of the refill station, and controlling the refill of the dispenser can with the active substance by a control unit of the refill station.

In the context of the present application, a "refill station" may in particular denote an apparatus which is configured for refilling a dispenser can which is at least partially empty and mechanically and fluidically couplable with the refill station with an active substance from an active substance container (German: Wirkstoffgebinde) to be connected. A refill station may therefore provide a fluidic connection between a container for providing the active substance to be refilled and the dispenser can to be refilled, and optionally for providing a pressure gas to be refilled at the dispenser can.

In the context of the present application, a "receiving device" may in particular denote a mechanical and fluidic adapter which is configured for receiving, in particular in a form-locking manner, a dispenser can to be refilled, and can provide the active substance and/or a pressure gas to the dispenser can in the received state. Beyond the mechanical adapter function, the receiving device may also function as a fluidic adapter for providing a fluid connection between a container with the active substance and the dispenser can to be refilled with the active substance.

In the context of the present application, a "dispenser can" (German: Spenderdose) (for example configured as aerosol can) may in particular denote a can which is handable by a user, which is configured for discharging (in particular for spraying a spray mist or for discharging an active substance in form of an active substance beam, a foam, or a gel) preferably liquid active substance. This active substance is pressurized in an interior of the dispenser can, wherein pressure gases or propellant gases in the dispenser can (for example propane, butane, compressed air, carbon dioxide, helium, or oxygen) may be used for discharging the active substance from the dispenser can. Through a nozzle, the ingredients (in particular the active substance or an active substance-propellant gas-mixture) can be sprayed, dispensed, and/or discharged in another form out of the aerosol can. In particular, a medium which is located in the aerosol can, can be sprayed out of the aerosol can as an aerosol.

In the context of the present application, an "active substance" may in particular denote a medium which, in a state sprayed out of the dispenser can, provides the actual function of the dispenser can. Such an active substance may comprise a liquid, a gel, a viscous medium, and/or a gas, optionally comprising solid particles. For example, such an active substance may be a cleaning agent (for example a brake cleaning agent), a rust remover, a maintenance oil, a silicone spray, a windows cleaning agent, a leakage detection medium, a welding spray, etc. In a refill station, such an active substance may be refilled from a container (for example a canister) into a dispenser can to be refilled.

In the context of the present application, a "control unit" may in particular denote a unit which controls the process of refilling the active substance into a dispenser can, in particular allows it in a defined manner or prevents it in an error case. In particular, such a control unit may comprise at least one processor and/or a part of a processor which evaluates a provided information about an intended and/or performed refill process and, if necessary, performs, adapts, restricts, extends, or prevents the refill process. In particular, for this purpose, the control unit may control or regulate individual components of the refill station.

In the context of the present application, a "deformable bag" may in particular denote a closed bag sleeve made of a material which unfolds and/or expands in case of a pressure increase, and which folds and/or contracts in case of a pressure drop. For example, when an active substance is filled or refilled into a deformable bag, the bag receives the active substance and is expanded or unfolded by a pressure which is provided by the active substance. On the contrary, if the active substance is discharged from the bag, the bag may contract or fold when a pressure gas which is for example located outside of the bag but within the dispenser can acts upon the bag from outside and the bag thus contracts, collapses, or folds. For example, the bag may be a foil bag which comprises at least one foil, such as a metal foil and/or a plastic foil.

In the context of the present application, a "refill valve" may in particular denote a fluid valve which is configured such that an, in particular liquid, active substance from an exterior of the dispenser can is conveyed into an interior of the bag through it. In particular, the dispenser can with its refill valve may be placed on a receiving device of a refill station, preferably in a form-locking manner and under formation of a fluid connection, to subsequently fill or refill the active substance from an active substance container by the refill station through the refill valve into the dispenser can. The refill valve may be a fluid valve which is normally closed, which opens only when an overpressure above a predetermined threshold value acts upon it.

In the context of the present application, an "outlet valve" may in particular denote a fluid valve which is configured such that an, in particular liquid, active substance is conveyed out of it from an interior of the bag to an exterior of the dispenser can. In particular, the dispenser can with its outlet valve may be coupled with an outlet unit (for example a spraying can) under formation of a fluid connection, to subsequently discharge the active substance out of the bag of the dispenser can to an environment of the dispenser can. The outlet valve may be a fluid valve which is normally closed, which opens only when an actuation pressure (or the like) above a predetermined threshold value which is exertable by a user by the outlet unit acts upon it.

According to an exemplary embodiment of the invention, a refillable dispenser can is provided which has to be filled with a pressure medium (for example a pressure gas) only once, and which can, without a refill of pressure medium, then pressurize an active substance which is repeatedly refillable with pressure of the pressure medium, for discharging it out of the dispenser can. For this purpose, the active substance can be repeatedly introduced through a refill valve into a deformable bag in the dispenser can which is fluidically coupled with the refill valve. When refilling with the active substance, the bag may expand. The pressure gas in the dispenser can which is located around the bag may pressurize the active substance in the bag with a permanent overpressure. When a user discharges the active substance out of the bag into an environment of the dispenser can by activating an outlet valve of the dispenser can, the pressure medium which is at overpressure with respect to an ambience pressure conveys the active substance out of the bag and through the outlet valve. By refilling the active substance through the refill valve, the bag which was previously at least partially empty is expanded again, such that the same pressure medium as for a previous filling of the dispenser can may also pressurize the refilled active substance for discharging. Thus, the pressure medium may remain permanently in the dispenser can, without the need of being refilled. The deformable bag serves as an intermediary between the pressure medium and the active substance to be discharged. With advantage, at the side of refilling and at the side of discharging, a respective fluid valve (refill valve and/or outlet valve) may accomplish a refill and a discharge of the active substance which is spatially separated from each other. In this way, repeatedly refilling the dispenser can with the active substance is enabled without the need of refilling also the pressure medium when refilling the active substance. This distinctly facilitates the refill of dispenser cans with respect to conventional approaches. At a dispenser can according to an exemplary embodiment of the invention, the pressure gas as propellant agent on the one hand and the active substance on the other hand are located in the dispenser can spatially separated from each other. The active substance is located in a separate flexible bag which is connected or connectable both with the outlet valve and with the refill valve, whereas compressed pressure gas can be located in the remaining space between the bag and a better can wall. The separation between the pressure medium and the active substance also increases the operational safety of the dispenser can. Therefore, when activating a discharging head (for example a spray head) of the dispenser can, the active substance is discharged through the outlet valve in a pure manner and not together with the pressure gas which may permanently remain in the dispenser can as pressure generating working medium. By the provision of a refill valve additionally to an outlet valve, the dispenser can may be used multiple times by refilling the previously emptied active substance, and thereby, after each refill process, the same pressure gas can be used again. Therefore, a dispenser can according to an exemplary embodiment of the invention is especially durable and resource-saving and simply handable at the same time.

In the following, additional exemplary embodiments of the dispenser can, the refill arrangement, and the method are described.

According to an exemplary embodiment, the refill valve may be arranged at a bottom side of the dispenser can. In this way, the refill valve may be placed on a receiving device of a refill station at a bottom side in a simple manner, whereby a fluidic refill conduit of the refill station at the receiving device can be fluidically coupled with the refill valve of the dispenser can. By supplying the active substance to the receiving device, the bag of the dispenser can may then be refilled with the active substance via the refill valve.

According to an exemplary embodiment, the outlet valve may be arranged at a top side of the dispenser can. By arranging the refill valve and the outlet valve at opposing sides of the dispenser can, it may be intuitively shown to a user that refilling the active substance is performed at a bottom side, and discharging the active substance is performed at a top side of the dispenser can. However, the handling of the dispenser can differs from conventional refillable dispenser cans in the fact that a refill of pressure gas is dispensable.

According to an exemplary embodiment, the refill valve and/or the outlet valve may be attached (in particular welded or glued) at the bag in a fluid-tight manner. In this way, an undesired leakage of the active substance out of the interior of the bag into a pressure gas volume and/or an undesired leakage of the pressure gas into the bag may be avoided. An especially simple configuration which makes this possible consists in welding the bag to the refill valve and the outlet valve. Alternatively, also a gluing of the respective valve with the bag in a gas-tight manner is possible.

According to an exemplary embodiment, the dispenser can may comprise a rigid can housing which encloses or receives the bag, with respect to which the refill valve and the outlet valve are exposed. In contrast to the bag, the can housing may be rigid and incompressible. The can housing may then form a robust exterior housing of the dispenser can. Moreover, the can housing may form a rigid pressure delimiting sleeve for the pressure medium which is located in the interior of the dispenser can. Descriptively, the pressure medium may pressurize and thereby deform the deformable bag in the interior of the can housing, whereas the pressure medium is delimited in a rigid manner by the rigid can housing at the outside.

According to an exemplary embodiment, the dispenser can may receive a pressure medium, in particular a pressure gas, in a volume between the bag and the can housing. In particular, the pressure medium may be a gas which is brought to a pressure above the atmospheric pressure, in particular to a pressure above 2 bar. For example, the pressure gas may be air or nitrogen or propane and/or butane which is brought to overpressure. With advantage, the pressure medium is to be filled into a volume between the can housing and the bag under overpressure only once at the factory side and may then repeatedly serve also in repeated refill processes of the active substance into the bag for exerting a pre-pressure on the active substance in the bag, without the need of being refilled.

According to an exemplary embodiment, a leakage through the refill valve and/or through the outlet valve is made impossible for the pressure medium. Therefore, the pressure gas volume between the can housing and the bag may be hermetically decoupled from the interior of the bag and from the exterior of the dispenser can. In this way, it is possible to repeatedly use the pressure medium, without the need to refill it, for discharging the refilled active substance.

According to an exemplary embodiment, the outlet valve may be configured for filling a pressure medium between the bag and the can housing. For filling the pressure medium and/or the pressure gas at the factory side into the pressure gas volume between the flexible, elastic, or foldable, deformable bag on the one hand and the rigid or non-deformable can housing on the other hand, for example the outlet valve (for example in combination with a distributor pipe which is temporarily lifted and thereby opened at the bottom side for inserting the pressure gas) may be used. After filling the pressure gas into the pressure gas volume through the outlet valve (and for example through a bottom-sided opening in the distributor pipe), the pressure gas volume in the interior of the dispenser can may be fluidically separated from the rest of the dispenser can (for example, the distributor pipe may be lowered and thereby fluidically decoupled at a bottom side from the pressure gas volume, and the bottom-sided portion of the distributor pipe may then be fluidically coupled for example with the refill valve for inserting the active substance).

Alternatively, filling the pressure gas into the pressure gas volume may also be performed through a separate valve in the can housing, for example, which may be, for example permanently, closed after filling the pressure gas into the pressure gas volume.

According to an exemplary embodiment, an active substance in the bag and the pressure medium between the bag and the can housing may be pressure-coupled with each other through the bag, without forming a direct contact between the active substance and the pressure medium. The pressure medium which is under overpressure may exert a pre-pressure on the active substance through the wall of the deformable bag. When the outlet valve is then activated for discharging the active substance (for example by activating a discharging head by a user), the outlet valve opens, whereby the active substance which is under pre-pressure by the pressure medium leaves through the outlet valve and the discharge head to an environment of the dispenser can. In this way, by the deformable bag, a pressure coupling between the pressure medium which surrounds the bag and the active substance in the bag is generated, without enabling a direct physical contact between the pressure medium and the active substance. Thereby, the pressure medium, in contrast to the active substance, is prevented from leaving the dispenser can and, after refilling the dispenser can with a new active substance, may generate a pre-pressure on the new active substance again, for a later discharge out of the dispenser can. By the separation of the media between the pressure medium and the active substance in the interior of the dispenser can, undesired chemical interactions between these both media can be avoided.

According to an embodiment, a volume between the bag and the can housing may be hermetically closed. In this way, a leakage of compressed pressure medium from an interior of the dispenser can can be avoided.

According to an embodiment, the can housing may be curved, in particular concavely curved, at its bottom side. The refill valve may be protected against mechanical influences and may nevertheless be accessible for a simple coupling to a receiving device of a refill station in a recess at the curved bottom side of the can housing. Moreover, by the curvature of the bottom side, the stability of the dispenser can on a ground and its mechanical rigidity may be improved.

According to an embodiment, the bag may be elastically deformable and/or unfoldable. An elastically deformable bag may be reversibly compressed under an external pressurizing and/or internal pressure decrease, and may be reversibly expanded in case of an external pressure decrease and/or an internal pressurizing. Therefore, an elastically deformable bag can reliably accomplish a pressure transfer between the bag interior and the bag exterior. Alternatively or additionally, it is possible to configure the bag reversibly unfoldable and/or foldable (for example using a metal foil). Folding the bag may be performed in response to filling the active substance into the bag. After evacuating the active substance out of the bag, triggered by pressurizing by the pressure medium around the bag, the bag foil may automatically be folded and/or contract.

According to an exemplary embodiment, the dispenser can may comprise an outlet unit, in particular a discharging head, on the outlet valve. Depending on the configuration of the outlet unit, the active substance which is leaving the discharging head may leave in different configurations. For example, the active substance may be discharged as a liquid beam or a gel stripe, as a spray mist or as a foam. Thus, the outlet unit may be configured in an application-specific manner, for example as a spray head.

According to an exemplary embodiment, the dispenser can may comprise a distributor pipe (which may also be denoted as a riser pipe (German: Steigrohr)) at least in portions in the bag, which is at least in portions arranged between the refill valve and the outlet valve and which comprises at least one sidewall opening (preferably a plurality of sidewall openings) for forming at least one passage (preferably a plurality of passages) for the active substance between an interior of the distributor pipe and a receiving volume of the bag. In particular, the distributor pipe may extend over the entire vertical region between the outlet valve and the refill valve. The distributor pipe may be a pressure-stable perforated pipe with a fluid connection to both the outlet valve and the refill valve, which may be surrounded by the bag along at least a part of its vertical extension, in particular along its entire vertical extension), and may therefore enable a bidirectional transfer of the active substance between the interior of the bag and the interior of the distributor pipe. With advantage, the rigid distributor pipe may impart stability to the dispenser can, even when the deformable bag expands or contracts when inserting or discharging the active substance. Advantageously, the distributor pipe, due to its passages for the active substance, may serve for a more homogenous distribution of the active substance transfer in the vertical direction between the bag and the distributor pipe.

According to an exemplary embodiment, the distributor pipe may comprise a plurality of sidewall openings which are axially and/or radially offset with respect to each other. Passages in the distributor pipe which are arranged distributed in a circumferential direction enable a more homogenous distribution of an active substance transfer in a horizontal plane. Axially spaced passages in the distributor pipe homogenize the active substance transfer in the vertical direction.

According to an exemplary embodiment, the distributor pipe may comprise a telescopic mechanism for enabling a length compensation of the distributor pipe. A telescopic pipe or a telescopic tube may be configured as a hollow cylindrical body which may enable, that individual elements (which are reduced in the diameter, for example) can be pushed into each other. Thereby, a usable length of the distributor pipe may be flexibly adapted to the requirements of an actual operation mode of the dispenser can, in particular to a degree of filling of the bag with the active substance. When contracting the bag, such a telescopic mechanism may follow the bag contraction and, when expanding the bag, may follow the bag expansion. Regardless the rigidity of the distributor pipe, due to its telescopic configuration, it can adapt its longitudinal extension depending on a degree of filling of the bag and can therefore avoid mechanical tensions in the interior of the dispenser can. In particular by being able to connect the refill valve of the dispenser can with a telescopic pipe or telescopic tube (in particular configured as a slidable sleeve), it can be ensured that the refilled active substance reaches sufficiently far upwardly in the bag and can expand the bag even in a folded state with a low force and homogenously.

According to an exemplary embodiment, the distributor pipe may be preferably loosely plugged on the refill valve (or alternatively firmly connected with it). Preferably, the distributor pipe is loosely plugged on the refill valve. This may facilitate the filling of pressure medium at the fabrication side which may be accomplished through the outlet valve in cooperation with a temporarily exposed bottom-sided opening of the distributor pipe. Moreover, merely plugging a bottom side of the distributor pipe on the refill valve facilitates a mounting of the dispenser can.

According to an exemplary embodiment, the distributor pipe may be preferably firmly connected on the outlet valve (or may alternatively be loosely plugged on it). Firmly connecting the distributor pipe at its top side with the outlet valve promotes a fluid-tight connection between the distributor pipe and the outlet valve without introducing challenges in mounting the dispenser can. When manufacturing and/or mounting the dispenser can, the distributor pipe (preferably with the bag) may be introduced in a receiving of the can housing in a state firmly connected to the outlet valve.

According to an exemplary embodiment, the refill arrangement may comprise an active substance container which contains the active substance and which is coupled or couplable with the receiving device, to provide the active substance for refilling the dispenser can. For example, such an active substance container may be a canister or a barrel, for example with a receiving volume for the active substance in the range from 5 l to 100 l, in particular in a range from 5 l to 80 l.

According to an exemplary embodiment, by refilling the active substance, a pressure medium, in particular a pressure gas, in a volume between the bag and a rigid can housing of the dispenser can may be pressurized. When the pressure medium is hermetically enclosed in the volume between the bag and the can housing, it can repeatedly exert a discharging pressure on the refilled active substance in the bag, without the need of itself being refilled in the dispenser can when refilling the active substance into the bag.

In the following, exemplary embodiments of the present invention are described in detail with reference to the following figures.

DETAILED DESCRIPTION OF EXEMPLARY EMBODIMENTS

Same or similar components in different figures are provided with the same reference numbers.

Figure 1:
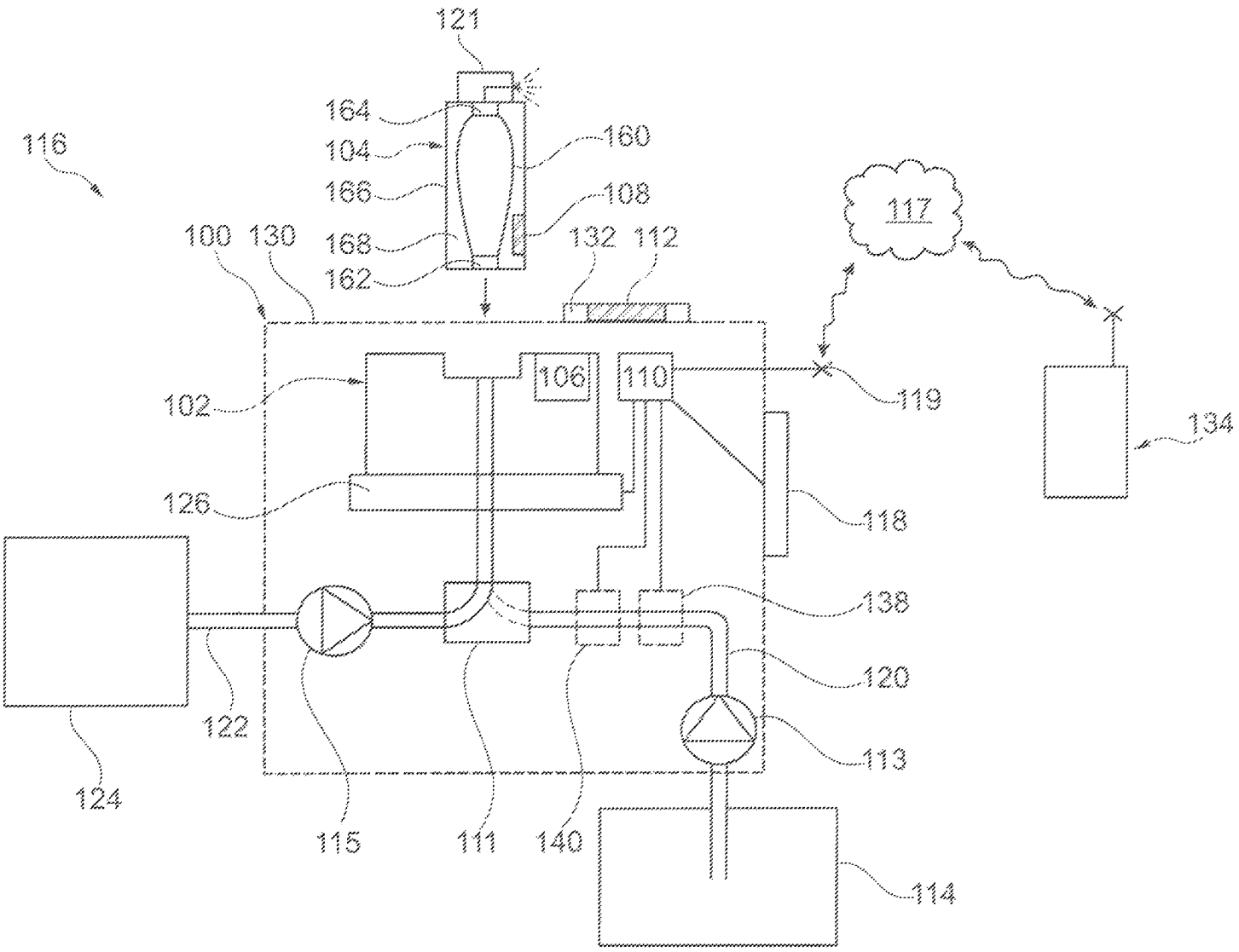
FIG. 1 shows a refill arrangement with a refill station, an active substance container, and a dispenser can, according to an exemplary embodiment of the invention.

Before, referring to the figures, exemplary embodiments of the invention are described, some general aspects of embodiments of the invention shall be explained.

According to embodiments of the invention, a refill station is provided which uses an active substance from a container (for example a 20 l canister or a 60 l barrel), to fill or refill a dispenser can. For example, the dispenser can may be an aerosol can with a filling valve at its bottom side. Furthermore, a mechanical code may be formed at the bottom side of the dispenser can which corresponds to a respective shape of a receiving device of the refill station. Moreover, the dispenser can may comprise a spraying valve for discharging an active substance and/or a medium out of the dispenser can at its top side.

The filling station may comprise a fluid connection to a container from which the active substance is filled into the dispenser can to be refilled. For example, such a fluid connection may be formed by a tube, to supply the active substance and/or the medium to a dispenser can from the container of the refill station. Preferably, such tubes are capable for a ESD-removal (ESD=electrostatic discharge). In particular, the refill station may comprise a receiving device or an attachment unit (German: Aufsetzeinheit) for the dispenser can with a mechanical code, for enabling only mechanically fitting encoded dispenser cans on a corresponding refill station. Furthermore, a fastener may be provided at the receiving device, to hold the dispenser can at the receiving device during its refill. Preferably, the dispenser can, regardless of its angular position to the receiving device, i.e. descriptively freely positionable around 360°, may be configured rotatable around the longitudinal axis on the coding plate (German: Kodierteller), without impeding the correct connection between the dispenser can and the receiving device. Optionally, the refill station may be equipped with a pressure air terminal (wherein pressure air is available in each car repair shop, for example), to fill pressure air into the dispenser can together with the active substance. The control of the filling process may be performed by a control unit. For example, when filling a dispenser can, firstly the active substance and subsequently a pressure medium (for example pressure air) may be conveyed. Both may be controlled, for example pneumatically, by a three way valve. For this purpose, the refill station may be equipped with a piston with a cylinder (for example a stainless steel cylinder or a plastic cylinder), to receive the active substance and to fill a defined amount of the active substance into the dispenser can.

Advantageously, the refill station may be connected to an electrical potential equalization, since the friction of the active substance when refilling may lead to an electrostatic charging. For example, a mounting of a refill station in a shelf may be performed, wherein in the shelf, at least one container (for example a canister, for example with a volume of 20 l) may be arranged. It is also possible to form a refill station with a placing part (German: Aufsatz) on an active substance barrel (for example with a volume of 60 l), or in a hazardous goods storage cupboard as a ballast adapter (German: Auflastadapter). A suitable potential equilibration may be achieved by grounding.

According to an exemplary embodiment of the invention, a refillable dispenser can with a deformable bag for refilling the active substance and with a hermetically closed volume with a permanently received pressure medium between a rigid can housing and the bag may be provided. With advantage, the bag may be equipped on the one hand with an outlet valve for discharging the active substance out of the bag using the pressure medium as discharging working medium, and on the other hand with a refill valve for refilling the active substance into the bag. With advantage, such a dispenser can may be repeatedly refilled over a long lifetime through the refill valve with a new active substance, without the need of refilling the pressure medium which is located permanently in the pressure can. Discharging the active substance out of the dispenser can is conveniently enabled for a user by merely actuating the outlet valve. Thereby, a dispenser can may be provided which can be manufactured and operated in a durable and resource-saving manner, and which ensures a high user comfort and a high operational safety at the same time. From a safety point of view, the permanent separation of the pressure gas and the active substance is especially advantageously.

For example, a dispenser can according to an exemplary embodiment of the invention may be configured as an aerosol can which comprises pressure air and a bag with the active substance. The bag may comprise an outlet valve for the active substance at its top side and an inlet valve or a refill valve at its bottom side for introducing or refilling the active substance. In particular, at the bottom-sided refill valve, a tube, preferably a slidable sleeve or the like, may be attached or attachable for enabling to bring the medium which is introduced through the refill valve in the vicinity of the outlet valve. Advantageously, a multi-filling of the dispenser can of the BoV-type is possible (for example at a logistics branch, a petrol station, a workshop, etc.). Especially advantageously is providing a BoV-dispenser can with two separated valves for discharging and/or filling the bag. The provision of a telescopic tube or telescopic pipe in the interior of the bag is also advantageous, since this promotes a spatially homogenous distribution of the active substance during filling and/or discharging, and therefore an error-free operation of the dispenser can.

FIG. 1 shows a refill arrangement 116 with a refill station 100, an active substance container 114, and a dispenser can 104 according to an exemplary embodiment of the invention. The refill arrangement 116 serves for filling or refilling a dispenser can 104 which is entirely or partially empty or emptied with an active substance (for example a brake cleaner), for being able to fill the dispenser can 104 with an assigned active substance by a user in a simple manner. The active substance may then be sprayed, or more generally being discharged, out of the dispenser can 104 at a location of use. After evacuating or re-evacuating the dispenser can 104, the dispenser can 104 may then be filled again at the refill arrangement 116 with a new active substance, etc.

For this purpose, the refill station 100 comprises a receiving device 102 which acts as a dispenser can adapter for receiving a dispenser can 104 in a form-locking and fluid-coupling manner which is to be refilled with an active substance. The receiving device 102 may be configured as a coding plate which has a mechanical interface which is shape-adapted to a corresponding mechanical interface of the dispenser can 104 to be refilled. In this way, only mechanically fitting dispenser cans 104 can be attached at the receiving device 102, which makes an erroneous operation improbable. Despite this is not illustrated in FIG. 1, at the receiving device 102, a fastener unit may be attached, by which a dispenser can 104 which is attached to the receiving device 104 can be fastened at the receiving device 102 during filling. In this way, it can be excluded that during refilling, a pressure which is exerted on the dispenser can 104 or acting forces lead to an undesired release of the dispenser can 104 from the receiving device 102. After the finished refill, the fastening unit may either automatically release the dispenser can 104 or can be transferred in a state which is releasing the dispenser can 104 by a user actuation. A user may then remove the refilled dispenser can 104 from the receiving device 102 and bring it to a location of use.

Furthermore, the refill arrangement 116 may comprise the active substance container 114 which, for example as canister or barrel, may be filled with an active substance to be refilled (for example brake cleaner). Therefore, the active substance container 114 contains the active substance which is to be refilled into the dispenser can 104 and may be fluidically coupled or couplable with the receiving device 102, to provide the active substance for refilling the dispenser can 104.

If the dispenser can 104—different than in FIG. 1, see description below—is not a BoV (bag-on-valve)—dispenser can with a pressure medium which is permanently contained therein, the refill arrangement 116 may further comprise a gas reservoir 124 which is configured for providing pressure gas and which is fluidically coupled or couplable with the receiving device 102. In this way, by the gas reservoir 124, pressure gas (for example pressure air) for refilling into the dispenser can 104 may be provided. For example, the gas reservoir 124 may be a terminal to a pressure gas conduit or a pressure gas bottle in which gas under overpressure is contained.

As illustrated in FIG. 1, at least one valve 111 which is configured as a three way valve in the illustrated embodiment may form a fluid connection between the active substance container 114, the optional pressure gas reservoir 124, and the receiving device 102. As shown, the receiving device 102 may be fluidically coupled with an active substance supply unit 120 for supplying the active substance from the active substance container 114 in a dispenser can 104 which is received at the receiving device 102. Furthermore, the receiving device 102 may be fluidically coupled with an optional pressure gas supply unit 122 for supplying the pressure gas from the gas reservoir 124 into the dispenser can 104 which is received at the receiving device 102. For example, the at least one valve 111 may be controlled by a control unit 110, such that at first only the active substance is filled into the at least partially empty dispenser can 104, before the at least one valve 111 is switched, such that subsequently only pressure gas from the gas reservoir 124 is filled into the dispenser can 104. Thereby, it can be ensured that a predefined amount of the active substance is filled into the dispenser can 104. Between the active substance container 114 and the receiving device 102, a conveying unit 113, for example a pump, may be arranged, for conveying the active substance from the active substance container 114 to the receiving device 102 and from there into the dispenser can 104. Optionally, also between the gas reservoir 124 and the receiving device 102, a conveying unit 115, for example a compressor or a pump, may be arranged.

FIG. 1 shows with an arrow how the dispenser can 104 is placed on the receiving device 102. In a bottom region of the dispenser can 104 in the region of its refilling valve 162, the dispenser can 104 is equipped with a dispenser can-transponder 108, for example a RFID-tag. At said bottom region, the dispenser can 104 is received at the receiving device 102. Such a dispenser can-transponder 108 which is able to communicate in a contactless manner, may be glued on the dispenser can 104 as a label, for example, or can be attached or embedded at and/or in a can housing 166. In a solid body memory of the dispenser can-transponder 108, dispenser can related data are stored which for example can identify or characterize the dispenser can 104 and an active substance which is to be filled in it, and/or may contain an information about a receiving volume of the dispenser can 104, an information about desired pressure gas properties in the dispenser can 104, an information about a user of the dispenser can 104, etc.

In the receiving device 102, a transponder-reading device 106 for reading the dispenser can related data of the dispenser can-transponder 108 which is attached to the dispenser can 104 in a contact-free manner is arranged. The transponder-reading device 106 is arranged in a region of the receiving device 102 such that the dispenser can 104 is only located in a reading region of the transponder-reading device 106 when the dispenser can 104 is attached to the receiving device 102. Thereby, it is advantageously ensured that erroneous reading processes of dispenser cans 104 by the transponder-reading device 106 which are located in a larger environment of the transponder-reading device 106 are reliably prevented. For this purpose, the transponder technology on whose basis the transponder-reading device 106 and the dispenser can-transponder 108 communicate, may be configured as a short-range transponder technology, for example with a range of below 10 cm, in particular below 5 cm (for example as short-range RFID-technology). Thereby, the dispenser can related data of the dispenser can-transponder 108 may be selectively read by the transponder-reading device 106 only when the dispenser can 104 is attached to the receiving device 102. The read data may be supplied from the transponder-reading device 106 to a control unit 110 or may be stored in a not illustrated electronical mass storage of the refill station 100.

Preferably, also the active substance container 114 is provided or associated with an active substance storage-transponder 112 (not shown). In a solid body memory of the active substance container-transponder 112, active substance container related data are stored which are selectively readable by the transponder-reading device 106, when the active substance container-transponder 112—as shown—is attached to a housing 130 of the refill station 100. To enable or to simplify the readability of the active substance container-transponder 112 by the transponder-reading device 106, the active substance container-transponder 112 may be configured as a label 132 which is separable from the active substance container 114 in a defined manner. For example, the label 132 may be configured as an adhesive label which is equipped with the active substance container-transponder 112, which a user can separate from the active substance container 114 which is for example configured as a canister and can be glued to a position which is provided for this purpose (and which is for example correspondingly marked) at the housing 130. By attaching or adhering or alternatively providing, the active substance container-transponder 112 can be brought into the readability distance of the transponder-reading device 106, such that the active substance container related data can be read by the transponder-reading device 106. By the fact that also the active substance container-transponder 112 firstly must be transferred by a defined user activity into the readability distance of the transponder-reading device 106, before the active substance container related data can be captured by the transponder-reading device 106, a reliable protection against reading false active substance container related data is provided. For example, the active substance container related data may contain an information about the active substance in the active substance container 114, about a filling amount or residual filling amount in the active substance container 114, an information about a dispenser can 104 or the refill station 100 which is suitable for this active substance, etc.

The control unit 110 can evaluate the dispenser can related data and the active substance container related data which are provided to it by the transponder-reading device 106, and can examine them, for example with respect to their compatibility. In particular, the control unit 110 can be determined from the data which are read by the transponder-reading device 106, if the active substance which is provided by the active substance container 114 fits into the dispenser can 104 which is received at the receiving device 102. In this way, the operational safety can be increased, since it can be excluded that a dispenser can 104 which is unsuitable for a, for example dangerous, active substance (which for example comprises gasoline and is thus at the risk of fire) is used. In a corresponding manner, it can be excluded, that an active substance which origins from an unreliable source is permitted for the refill of a dispenser can 104. Even when a user manipulates the shape of a dispenser can 104, to mount it on a receiving device 102 regardless the incompatibility of an active substance container 114 which is fluidically coupled with the receiving device 102, this may be recognized by the control unit 110 by reading the dispenser can-transponder 108. Filling a dispenser can 104 which is unsuitable for a certain active substance may thus be reliably avoided by the described transponder-configuration. Thereby, a high operational safety can be achieved when using the refill arrangement 116. If the dispenser can related data and the active substance container related data show a compliance, the refill process is triggered or permitted by the control unit 110, in other cases, the refill process is prevented or not permitted.

FIG. 1 further shows that a portable user end device 134 is communicatively coupled with a software app for a user-sided control of the refill arrangement 116 by the control unit 110. The user end device 134 may be a mobile radio device which may be communicatively coupled in a wireless manner via a communication network 117 (for example a mobile phone network or the public Internet) with a communication interface 119 of the refill station 110. Thus, a user may transmit control commands to the refill arrangement 116 or monitor the operation of the refill arrangement 116 from a remote position.

Furthermore, FIG. 1 shows that the refill station 100 comprises a display unit 118 for displaying an information, such as dispenser can related data, active substance container related data, and/or another information for a user. For example, the display unit 118 may be configured as an LCD-display or a touchscreen. By the display unit 118, during and/or after a refill process, an associated information can be shown to a user at the display unit 118.

With advantage, the refill station 100 according to FIG. 1 may comprise a scale (German: Waage) 126 which is for example configured as a beam scale (German: Balkenwaage), for capturing a weight, or a weight information which is indicative for it, of the dispenser can 104 at the receiving device 102 prior to a refill process and/or during a refill process. A weight capturing of the dispenser can 104 prior to a refill process enables to qualitatively or quantitatively determine a possible residual filling of the dispenser can 104 with the active substance and/or with a pressure gas, and to correspondingly adapt or perform a refill process which is subsequently to be performed. By considering a possible residual filling of the dispenser can 104 prior to its refill, an overfilling of the dispenser can 104 can be avoided. It is also possible to monitor the weight gain of a dispenser can 104 to be refilled during a refill process, to avoid a possible overfilling and underfilling. The control unit 110 to which the results of the weight capturing by the scale 126 can be provided, may consequently be configured to control a refill of the dispenser can 104 with the active substance based on the captured weight.

Preferably, the scale 126 may be configured for capturing a sum weight information which is indicative for a sum weight of the dispenser can 104, a residual filling of the active substance in the dispenser can 104 and a part of the refill station 100 (in particular at least a part of the receiving device 102) prior to a refill process and/or during a refill process. By the control unit 110, a refill of the dispenser can 104 with the active substance may then be controlled based on the captured sum weight information. With advantage, it may thus be dispensable to specifically capture only the weight of the dispenser can 104. It is also possible, and metrologically substantially simpler, to simply capture the mentioned sum weight, since a separation of the dispenser can 104 and the receiving device 102 during the weight determination process is then dispensable. By, prior to attaching a dispenser can 104 at the receiving device 102, capturing an empty weight of the receiving device 102 without the dispenser can 104, the residual weight which is different from the dispenser can weight of the sum weight can be mathematically subtracted, when, after attaching the dispenser can 104 to the receiving device 102, the sum weight is determined by the scale 126.

As already described, after attaching a dispenser can 104 to be refilled at the receiving device 102, by the control unit 110, a refill of the dispenser can 104 with the active substance may be permitted only when the data which are determined by the transponders 108, 112 indicate a compatibility of a dispenser can 104 which is attached to the receiving device 102 for being refilled with an active substance which is provided from a connected active substance container 114.

Alternatively or additionally, permitting a refill of a dispenser can 104 with an active substance can be made depending on the fact that an active substance which is captured at a capturing unit 138 fulfills at least one predetermined permissibility criterion. As a permissibility criterion may be used, if the active substance which is delivered in the supply unit 120 is an active substance which is permissible for the dispenser can 104, and/or if the captured active substance in the supply unit 120 fulfills an active substance origin which is considered as permissible for the dispenser can 104.

As shown in FIG. 1, by the capturing unit 138, a measurement may be performed at the active substance supply unit 120 for supplying the active substance from the active substance container 114, which measurement serves for characterizing and/or identifying the active substance which flows through the supply unit 120 which is for example configured as a tube when refilling a dispenser can 104. In this way, an active substance can be recognized which shall be used for refilling a dispenser can 104 against one or more predetermined permissibility criteria.

For example, an active substance which is permitted for refilling a dispenser can 104 may be provided with an optically recognizable marker, for example a fluorescence marker or a DNA-marker at the factory side. In this way, an active substance can be labeled which is for example permitted for refilling into a certain dispenser can 104, and/or fulfills required quality criteria. When such an active substance is conveyed through the supply unit 120, during the conveyance, by the capturing unit 138, it can be, preferably optically, recognized, if the active substance fulfills a predetermined permissibility criterion or not. For example, the permission of the filling of a dispenser can 104 with the active substance may be made depending on being able to optically capture an expected fluorescence signal by the capturing unit 138.

Data which are captured by the capturing unit 138 and which are indicative for the predetermined permissibility criterion can be supplied to the control unit 110. The control unit 110 may then allow or reject a refill of the dispenser can 104 with the active substance, namely depending on the fact, if or if not, the active substance which is captured at the capturing unit 138 fulfills the predetermined permissibility criterion. For example, an active substance may be permitted for refilling a dispenser can 104 only when a corresponding expected fluorescence marker is contained in the active substance, which for example indicates a certain active substance and/or the affiliation of the active substance to a reliable source (for example from a certain manufacturer). The examination of a predetermined permissibility criterion thus ensures a high quality of the active substance and an operational safety of the active substance in combination with the dispenser can 104.

In the illustrated embodiment, the capturing unit 138 is configured as an optical capturing unit for capturing a predetermined optical signal characteristic of the active substance to be refilled. The presence of said signal characteristic shows, that the active substance fulfills the predetermined permissibility criterion. With advantage, the capturing unit 138 may capture the active substance in the tube and/or in the supply unit 120, preferably during flowing through the supply unit 120. When the capturing unit 138 has determined the signal characteristic of the active substance candidate for refilling a dispenser can 104, this signal characteristic may be transferred to the control unit 110 for an evaluation. The control unit 110 may then, for example based on a comparison between the determined actual signal characteristic and an expected target signal characteristic, decide, if the signal characteristic indicates the fulfillment of the predetermined permissibility criterion or not. Depending on the result of this examination, the control unit 110 may then take actions to allow the refill of the dispenser can 104 with the active substance or not.

If the captured signal characteristic indicates that the active substance does not fulfill the permissibility criterion, the control unit 110 may control a prevention unit 140 for preventing the refill of the dispenser can 104 with the active substance. For example, the prevention unit 140 may press together a supply unit 120 which is configured as a flexible tube, such that no active substance can pass the supply conduit 120 anymore. Alternatively, the prevention unit 140 can introduce a curable adhesive in the supply unit 120 which is configured as a supply conduit, which chemically closes the supply conduit 120 and makes it impossible to conduct an active substance through this supply conduit 120.

The dispenser can 104 may comprise a mixture of the active substance and pressure gas in its interior, wherein, when activating an actuation nozzle 121, an active substance-pressure gas-mixture, for example as an aerosol, is discharged from or rinsed out of the dispenser can 104. In this case, for refilling the dispenser can 104, both new active substance and new pressure gas is required.

Alternatively, the dispenser can 104 may be configured as a specially configured bag-on-valve dispenser can, as illustrated in FIG. 1. The refillable dispenser can 104 which is shown in FIG. 1 serves for discharging an active substance and comprises a deformable bag 164 receiving the active substance in its interior. For example, the bag 160 may be made of plastic or a metal foil. At its bottom side, the bag 160 is fluid-tightly connected with a refill valve 162. The refill valve 162 may be placed on the receiving device 102 in a liquid-tight manner and may thereby be fluidically coupled with the refill station 100, to be able to fill or refill the bag 160 with the active substance from the active substance container 114. Moreover, the bag 160 is connected at its top side with an outlet valve 164 for user-definedly spraying the active substance out of the bag 160. The actuation nozzle 121 may be placed on the outlet valve 164, to open the outlet valve 164 by activating the actuation nozzle 121, and to thereby discharge the active substance out of the bag 160 in form of a spray.

Furthermore, the dispenser can 104 according to FIG. 1 comprises a rigid can housing 166 which receives the bag 160, with respect to which the refill valve 162 and the outlet valve 164 are exposed at the bottom side and/or at a top side. In other words, the outlet valve 164 and the refill valve 162 protrude from the rigid can housing 166 at a top side and at a bottom side. For example, the can housing 166 may be a rigid metal housing. A pressure gas may be fluid-tightly enclosed in an intermediate volume 168 between the bag 160 and the can housing 166, and can be protected against a leakage from the dispenser can 104. Therefore, it is made impossible for the pressure gas to leak through the refill valve 162 and/or through the outlet valve 164. Thus, when the active substance is sprayed through the outlet valve 164, the active substance is not mixed with the pressure gas, since the pressure gas remains in the intermediate volume 168 and thus in the dispenser can 104. Thereby, also a refill of pressure gas at the dispenser can 104 according to FIG. 1 is dispensable. Filling pressure gas into the intermediate volume 168 may be performed at the side of the manufacturer, for example, through one of the valves 162, 164 and/or through another valve in the can housing 166 (not shown).

Figure 2:
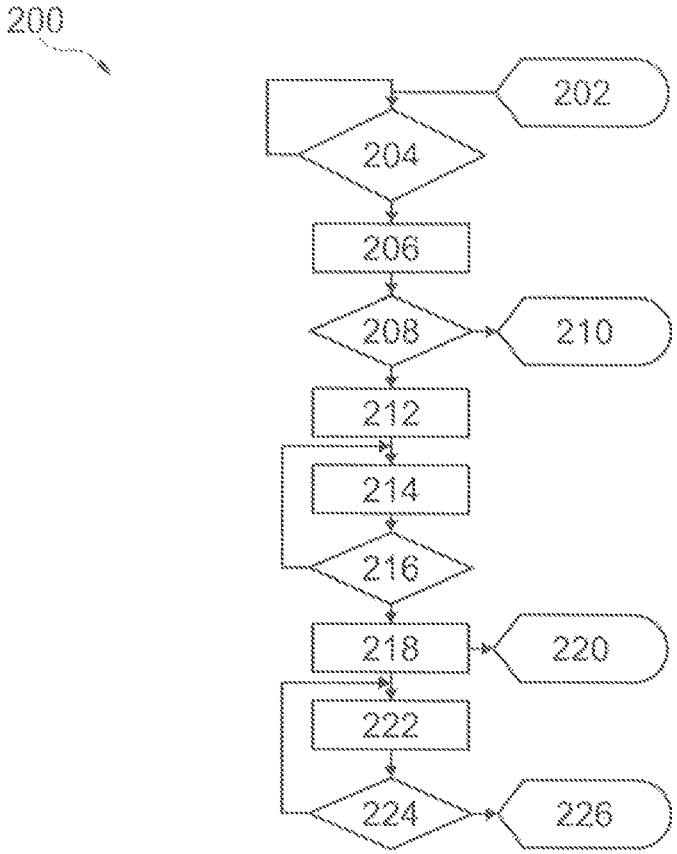
FIG. 2 shows a flow diagram which illustrates a method for operating a refill station according to an exemplary embodiment of the invention.

FIG. 2 shows a flow diagram 200 which illustrates a method for operating a refill station 100 according to an exemplary embodiment of the invention.

The method for operating a refill station 100 starts in a block 202 in which the refill station 100 indicates that it is ready for performing the method. This may be indicated at the display unit 118.

In a block 204, it is examined if a weight of a dispenser can 104 to be refilled which is captured by a scale 126 is within a predetermined range in a stable manner.

If this is the case, in a block 206, the dispenser can-transponder 108 is read by the transponder reading device 106. Furthermore, by the transponder reading device 106, an active substance container-transponder 112 can be read.

In a block 208, it is determined if an active substance and/or a medium which shall be filled into a dispenser can 104 is permissible. If this is not the case, the method concludes, that it is a false dispenser can 104, see block 210. This may be indicated at the display unit 118.

On the contrary, if this is the case, in a block 212, the residual amount of the active substance in the dispenser can 104 to be refilled is determined. Then, a pump 113 may be switched on, to deliver the active substance for a refill of the dispenser can 104 (block 214).

After refilling the dispenser can 104 with the active substance, it may be determined (for example by the scale 126) if the refilled amount of active substance in the dispenser can 104 is adequate, see block 216. If this is not the case, the method repeats the procedure according to block 214 and block 216.

On the contrary, if this is the case, the method determines in the block 218 the filling amount with the active substance and adds the entire filling amount. Corresponding to the block 220, this may be shown to a user at the display unit 118.

According to the optional block 222, the pump 115 and/or the compressor may then be switched on, to introduce pressure gas into the dispenser can 104.

In the block 224, it is examined if the pressure in the refilled dispenser can 104 is adequate. If this is not the case, the procedures according to block 222 and block 224 are examined.

On the contrary, if this is the case, the operational method is finished, see block 226. At the display unit 118, a corresponding information may be shown. An acoustic signal (for example generated by a buzzer) may indicate the completion of the operational method.

Additionally to the described procedure of filling, it is possible, prior to filling, to detect by a pressure pulse if the dispenser can 104 is correctly placed on the receiving device 102. Furthermore, after the filling, a data transmission to a communicatively coupled node is possible. It is also possible to detect if an active substance container 114 (for example a barrel or a canister) is empty. For example, this is possible by monitoring the weight course of such an active substance container 114 when filling the dispenser cans 104.

Figure 3:
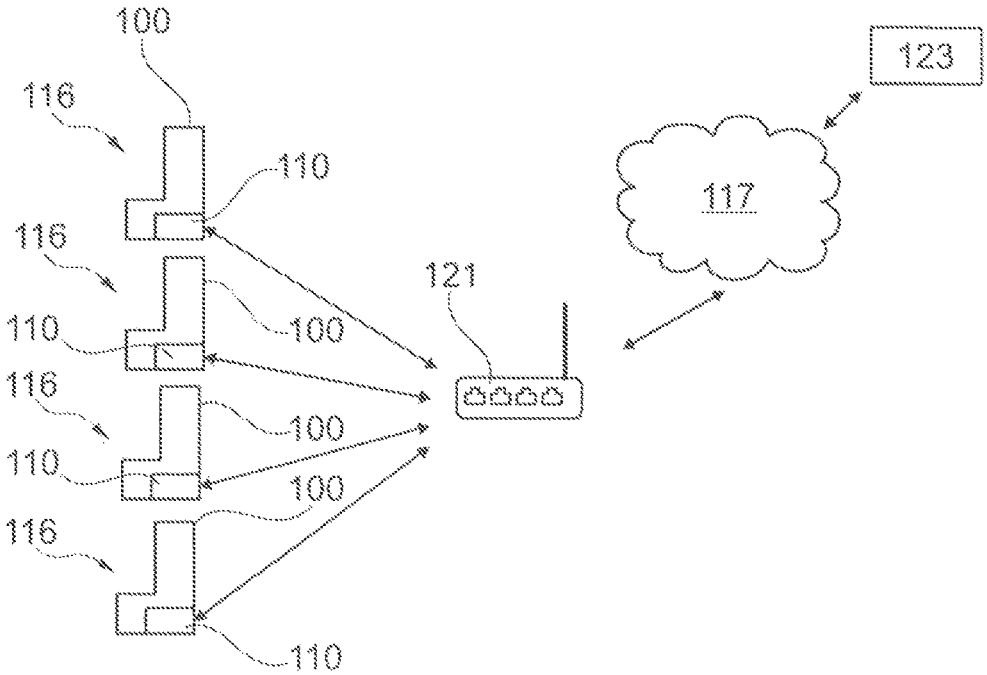
FIG. 3 shows a system with multiple refill arrangements according to an exemplary embodiment of the invention which are communicatively coupled with a reorder device.

FIG. 3 shows a system with multiple refill arrangements 116 according to an exemplary embodiment of the invention which are communicatively coupled with a reorder unit 123.

In the system according to FIG. 3, refill arrangements 116 with the above-described features are communicatively coupled with a node 121 (for example a gateway). The node 121 in turn is coupled via a communication network 117 with a reorder unit 123. When a control unit 110 and/or a scale 126 of a refill arrangement 116 recognizes that an active substance container 114 will be empty soon (for example since a residual filling of the active substance container 114 with an active substance fell below a certain threshold value), this information may be transmitted via the node 121 and the communication network 117 of the reorder unit 123, whereby a reorder of a new active substance container 114 with the active substance is triggered.

According to FIG. 3, consumption data with respect to the active substance may be transferred, for example to a Kanban-system. The transferred data may contain an identifier of a respective refill arrangement 116, an identifier of a dispenser can 104, a date and a time, and an active substance and a consumed and/or a reordered amount of the active substance. As illustrated, a node 121 may commonly function as a gateway for multiple refill arrangements 116. Software and in particular firmware may be installed at the refill arrangements 116, the nodes 121, and/or the reorder unit 123.

Figure 4:
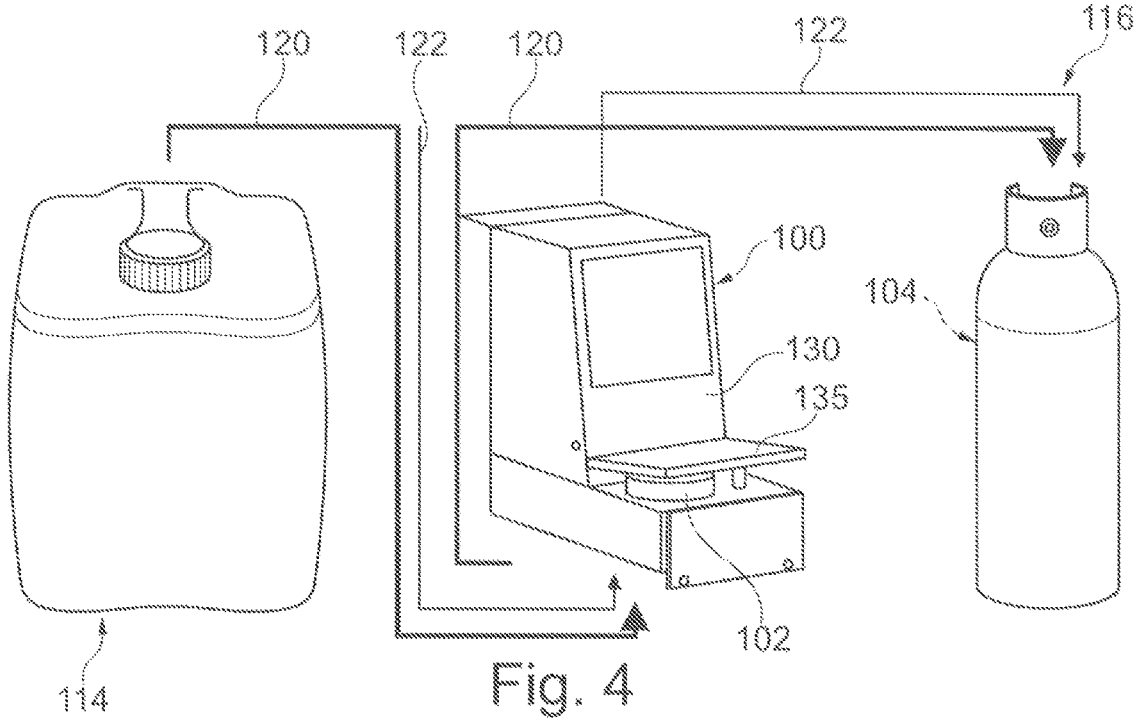
FIG. 4 shows a material flow in a refill arrangement with a refill station, an active substance container, and a dispenser can, according to an exemplary embodiment of the invention.

FIG. 4 shows a material flow in a refill arrangement 116 with a refill station 100, an active substance container 114, and a dispenser can 104, according to an exemplary embodiment of the invention.

The active substance may be transferred from the active substance container 114 via a supply unit 120 of the refill station 100 and from there to the dispenser can 104 which is mounted at a receiving device 102 after upwardly tilting a cover 135. The pressure gas may be transferred from a pressure gas reservoir via a supply unit 122 of the refill station 100 and from there to a dispenser can 104 which is mounted at the receiving device 102. If the dispenser can 104 is a BoV-dispenser can, refilling the pressure gas is dispensable.

Figure 5:
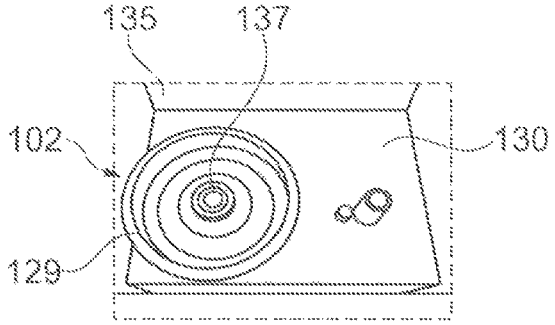
FIG. 5 shows a receiving device of a refill station according to an exemplary embodiment of the invention.

FIG. 5 shows a receiving device 102 of a refill station 100 according to an exemplary embodiment of the invention.

Figure 6:
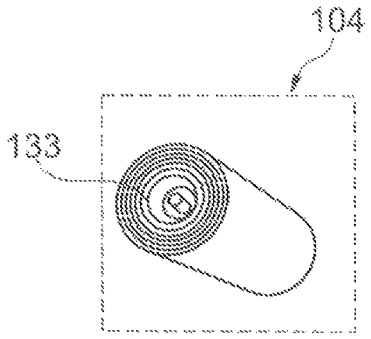
FIG. 6 shows a bottom of a dispenser can of a refill arrangement according to an exemplary embodiment of the invention.

FIG. 6 shows a bottom of a dispenser can 104 which is to be mounted at the receiving device 102 according to FIG. 5 of a refill arrangement 116 according to an exemplary embodiment of the invention.

At the receiving device 102, a coding plate 129 for receiving a bottom region 133 of the dispenser can 104 is formed. The coding plate 129 is formed mechanically complementary to the bottom region 133 of the dispenser can 104 (see FIG. 6). The coding plate 129 may be exposed by upwardly tilting a flap or a cover 135 according to FIG. 4. In a central region of the coding plate 129, a fluid terminal 137 is illustrated, which can be fluidically coupled with a refill valve 162 of the dispenser can 104, to refill the active substance and/or pressure gas through the refill valve 162 into the dispenser can 104 through the fluid terminal 137.

After mounting the dispenser can 104 at the coding plate 129, a locking unit for locking the dispenser can 104 at the coding plate 129 may be actuated, to prevent an undesired release of the dispenser can 104 from the receiving device 102 during the refill process. After finishing the refill process, the dispenser can 104 may be unlocked and removed from the receiving device 102.

Figure 7:
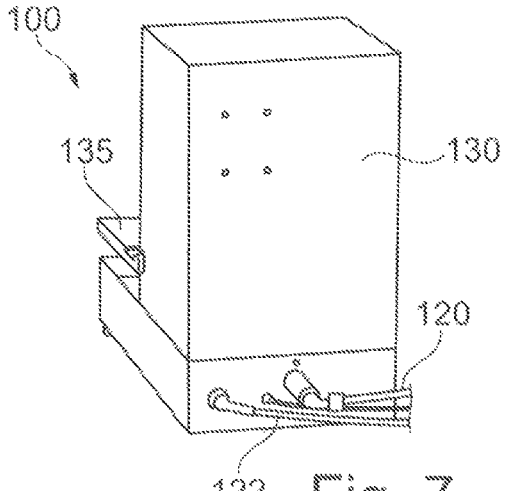
FIG. 7 shows a backside of a refill station according to an exemplary embodiment of the invention.

FIG. 7 shows a backside of a refill station 100 according to an exemplary embodiment of the invention. In particular, in FIG. 7, portions of the supply units 120, 122 are shown.

Figure 8:
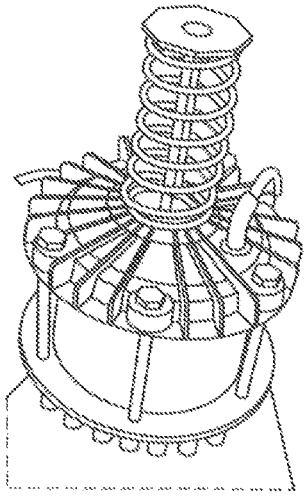
FIG. 8 shows a mechanism for refilling a dispenser can in a refill arrangement according to an exemplary embodiment of the invention.

FIG. 8 shows a mechanism for refilling a dispenser can 104 in a refill arrangement 116 according to an exemplary embodiment of the invention. Said mechanism contains a piston and a cylinder of a predetermined size, such that, by a suitable pressure, a filling amount to be dosed is definable.

Figure 9:
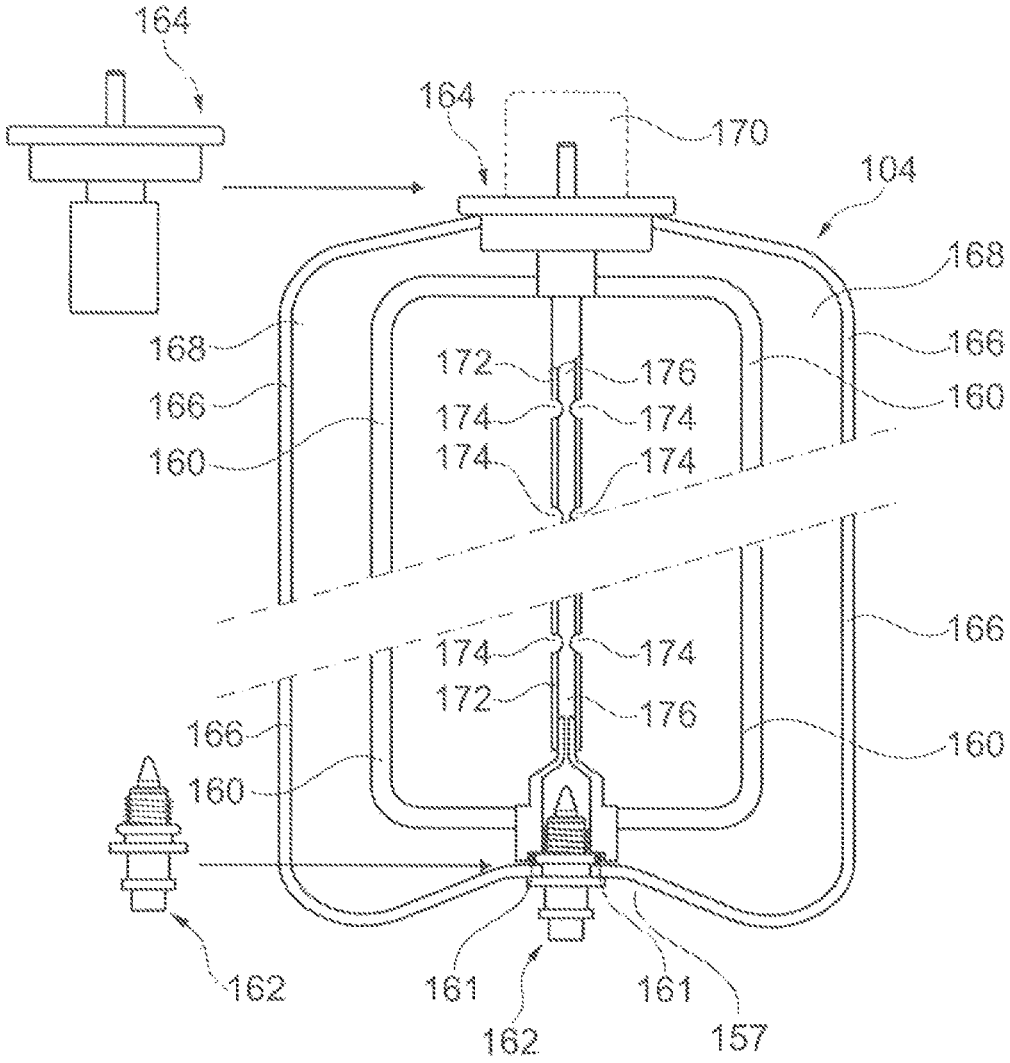
FIG. 9 shows a cross-sectional view of a refillable dispenser can with separated receiving volumes of the active substance and a pressure medium according to an exemplary embodiment of the invention.

FIG. 9 shows a cross-sectional view of a refillable dispenser can 104 (which is configured as a spraying can here) with separated receiving volumes for the active substance (for example a brake cleaner) and the pressure medium (for example air which is brought to overpressure with respect to the ambience pressure) according to an exemplary embodiment of the present invention.

Thus, the illustrated refillable dispenser can 104 serves for discharging a refillable and preferably liquid active substance and comprises a deformable bag 160 for receiving the active substance for this purpose. For example, the bag 160 may be made of a metal foil or a plastic foil and may be unfolded and thereby deformed during filling with the active substance. After evacuating the active substance out of the bag 160, the bag may contract or being folded, for example. Filling and/or evacuating the bag 160 may be controlled by the pressure ratios in the interior of the dispenser can 104 and by the operation of valves 162, 164, as described in more detail below.

The dispenser can 104 comprises at its bottom side a refill valve 162 which is connected with the bag 160 for connecting with a refill station 100 for refilling the bag 160 with the active substance. Such a refill station 100 may then be configured as it is described with respect to FIG. 1 (however without requiring a gas reservoir 124) or FIG. 10, for example. In more detail, for refilling the bag 140 with the active substance, the bottom side of the dispenser can 104 may be placed on the receiving device 102 of the refill station 100 in a form-locking manner, such that the active substance from an active substance container 114 is conveyed through the receiving device 102 and through the refill valve 162 into the bag 160.

Moreover, the dispenser can 104 comprises at its top side an outlet valve 164 which is connected with the bag 160 for user-definedly discharging the active substance out of the bag 160. In case of a configuration of the dispenser can 104 as a spraying can, an outlet unit 170 which is configured as a spray head on the outlet valve 164 may be actuated by a user, to spray the active substance out of the bag 160 through the outlet valve 164 and the outlet unit 170 out of the dispenser can 104 due to the pressure ratios which are described in the following. Alternatively, other outlet units 170 are possible.

Advantageously, the refill valve 162 is arranged at a bottom side of the dispenser can 104, such that the dispenser can 104 is displaceable on a receiving device 102 of the refill station 100 in an intuitive and stable manner. In contrast to this, the outlet valve 164 according to FIG. 9 is arranged at a top side of the dispenser can 104, such that a user can actuate the outlet unit 170 at the top side of the dispenser can 104 in a simple manner, to remove the active substance out of the dispenser can 104.

To ensure a fluid-tight connection between the bag 160 and the valves 162, 164, both the refill valve 162 and the outlet valve 164 may be welded or in any other way fluid-tightly attached to the bag 160 which is made of metal foils, for example.

The dispenser can 104 additionally comprises a rigid can housing 166 which receives and encloses from all sides the bag 160, which may be made of a suitably formed metal sheet, for example. The can housing 166 is formed substantially hollow cylindrical and has a concave indentation 157 at a bottom side. Thereby, the stability of the dispenser can 104 on a ground may be improved. Moreover, the indentation 157 improves the mechanical resistance of the dispenser can 104 against a deformation. Furthermore, the indentation 157 has the advantage that an end portion of the refill valve 162 which is protruding from the can housing 166 is, protected against mechanical influences, arranged in the indentation 157 and is nevertheless exposed for fluidically coupling with the receiving device 102. As shown in FIG. 9, the refill valve 162 is exposed and therefore externally accessible at a bottom side, and the outlet valve 164 is exposed and therefore externally accessible at a top side with respect to the can housing 166.

Advantageously, a pressure medium, for example air with an overpressure (for example in a range from 1.5 bar to 4 bar) above the atmospheric pressure, is filled in a hermetically closed volume 168 between the bag 160 and the can housing 166. A leakage through the refill valve 162 and/or through the outlet valve 164 is made impossible for the pressure medium. Thereby, the pressure medium permanently remains in the volume 168 and may function as a working medium there, for exerting a pre-pressure on the active substance in the bag 160.

For example, for filling the pressure medium between the bag 160 and the can housing 166 at the fabrication side, the pressure medium may be filled-in through the outlet valve 164 (for which in particular a distributor pipe 172 which is described in more detail below may be co-used, which may be temporarily separated at the bottom side from the refill valve 162 for this purpose and, in a manner deviating from FIG. 9, may also protrude beyond the bag 160 at the bottom side, if necessary). Filling the pressure medium into the volume 168 at the fabrication side may also be performed via a separate further valve, for example in the can housing 166 (not shown).

By the material of the bag 160 which is impermeable for the active substance and the pressure medium, the active substance in the bag 160 and the pressure medium between the bag 160 and the can housing 166 are pressure-coupled and/or force-coupled with each other through the flexible bag 160, whereas a direct physical contact between the active substance and the pressure medium is excluded. Thus, the pressure medium is not in a physical contact with the active substance, but is pressure-connected with it. Due to the spatial decoupling of the active substance and the pressure medium, the operational safety of the dispenser can 104 is improved, since each chemical interaction between the active substance and the pressure medium is avoided. Moreover, thereby, the pressure medium is protected against a leakage out of the dispenser can 104, when the active substance is discharged out of the dispenser can 104. Highly advantageously, refilling the dispenser can 104 with a pressure medium when refilling the dispenser can 104 with the active substance is therefore dispensable, since after refilling with the active substance, the same pressure medium as before can be used for pressurizing the refilled active substance.

Furthermore, FIG. 9 shows a distributor pipe 172 in the bag 160 which is plugged on the refill valve 162 at its bottom side. At its top side, the distributor pipe 172 is firmly connected with the outlet valve 164. Due to this configuration, the active substance which comes for example from an active substance container 114, which is conveyed through the refill valve 162 into the dispenser can 104 is at first conveyed into the lumen of the distributor pipe 172 and then reaches through a plurality of sidewall openings 174 in the perforated distributor pipe 172 into the interior of the bag 160. In a corresponding manner, the active substance from the bag 160 which shall be discharged (shall be sprayed or misted, for example) through the outlet valve 164 out of the dispenser can 104 is conveyed from the bag 160 through the sidewall openings 174 into the distributor pipe 172 and from there through the outlet valve 164 and the outlet unit 170 to an environment of the dispenser can 104. Thus, the sidewall openings 174 form passages 176 for the active substance between an interior of the distributor pipe 172 and a receiving volume of the bag 160. This has the advantage that, when refilling the active substance, it is filled temporarily in parallel on different height levels into the bag 160, which simplifies the refill especially in case of a collapsed or folded bag 160. In a corresponding manner, when discharging the active substance, it can be simultaneously guided through many passages 176 at first into the distributor pipe 172 and from there through the outlet valve 174, which leads to a homogeneous evacuation of the bag 160. With advantage, the distributor pipe 172 comprises a plurality of sidewall openings 174 which are axially and radially offset with respect to each other, whereby a more homogenous active substance transfer both in axial and in radial direction is caused. By arranging a perforated distributor pipe 172 with a plurality of sidewall openings 174 in the interior of the dispenser can 104, both filling and evacuating the bag 160 may be performed more homogeneously. In particular in case of a strong evacuation of the bag 160 by the active substance discharge, by the perforated distributor pipe 172, descriptively a crumpling of the bag 160 can be avoided.

Advantageously, the distributor pipe 172 may comprise a telescopic mechanism for enabling a length compensation of the distributor pipe 172. Descriptively, the distributor pipe 172 may be made of a plurality of pipe portions which are arranged within each other, which are connected with each other and are transferable between different use lengths. When unfolding/folding and/or expanding/contracting the bag 160, the distributor pipe 172 may automatically adapt to the bag 160 with respect to its length, whereby the dispenser can 104 can be reliably protected against a damage in operation.

By merely plugging the distributor pipe 172 on the refill valve 164 and by the telescope-like configuration of the distributor pipe 172, the components of the dispenser can 104 are mechanically relieved in operation, by enabling a delimited compensation between these components in a defined way.

For example, the outlet valve 164 may be a BoV (Bag on Valve)-valve which may be performed by the one-time filling of the volume 168 with the pressure medium (in particular with pressure air, or propane and/or butane). As refill valve 162, for example a screwable medium valve may be used. The refill valve 162 may be attached by a sealing 161 (for example an O-ring) to a bottom side of the can housing 166.

Figure 10:
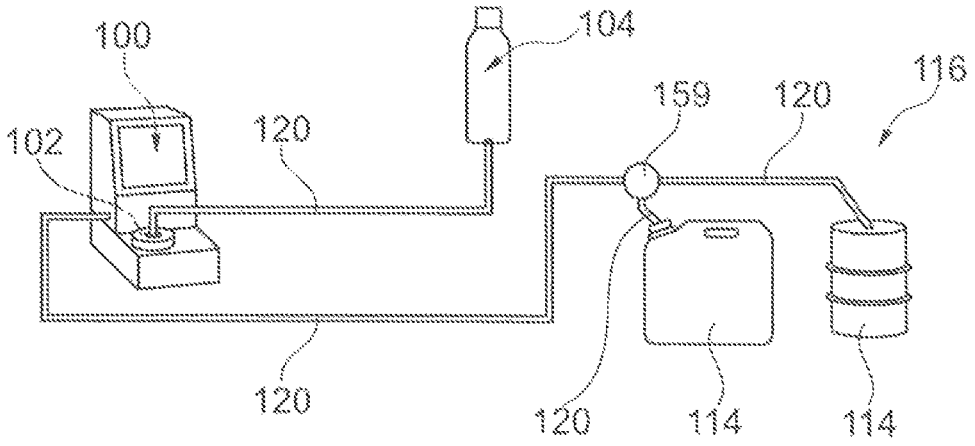
FIG. 10 shows a refill arrangement with a refill station, active substance containers, and a refillable dispenser can with separated receiving volumes of the active substance and the pressure medium, according to an exemplary embodiment of the invention.

FIG. 10 shows a refill arrangement 116 with a refill station 100, active substance containers 114, and a refillable dispenser can 104 with separated receiving volumes of the active substance and the pressure medium, according to an exemplary embodiment of the present invention.

The refill arrangement 116 which is illustrated in FIG. 10 has at its refill station 100 a receiving device 110 which may be configured according to FIG. 5, for example, and may be configured for receiving the dispenser can 104 to be refilled with an active substance. Furthermore, in the refill station 100, a control unit 110 may be contained which is for example configured as a processor for controlling the refill of the dispenser can 104 with the active substance, which may be configured according to FIG. 1, for example. The dispenser can 104 (for example configured according to FIG. 9) may be attached to the receiving device 102. Moreover, according to FIG. 10, two different active substance containers 114 with the active substance to be refilled may be fluidically coupled via a supply unit 120 with the receiving device 102, to provide the active substance for refilling the dispenser can 104. For example, by a fluid valve 159, a respective one of the active substance containers 114 can be selected.

During refilling the active substance from a selected active substance container 114 through the refill station 100 and its receiving device 102 into the interior of the bag 160 of the dispenser can 104, the pressure gas in the volume between the bag 160 which expands due to the refill and the rigid can housing 166 of the dispenser can 104 is pressurized or brought to an increased overpressure. The pressure gas, which was on overpressure prior to evacuating the active substance out of the dispenser can 104 and was relaxed by discharging the active substance and the resulting contraction of the bag 160 under the pressure reduction, may thus be automatically brought to a higher overpressure again by the refill process, which is usable as conveying pressure when discharging the refilled active substance. Therefore, a user activity for reactivating the partially relaxed pressure gas beyond triggering the refill is advantageously dispensable.

Figure 11:
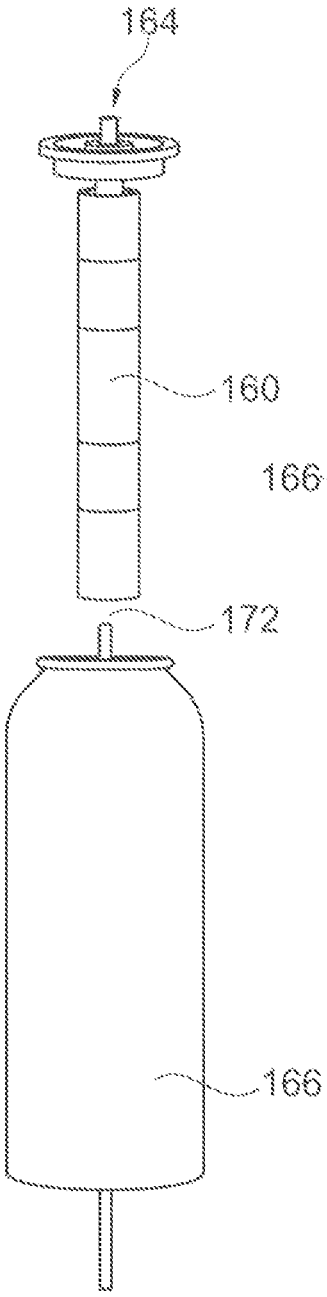
FIG. 11 to FIG. 13 show different views during a method for manufacturing a refillable dispenser can with separated receiving volumes of the active substance and the pressure medium according to an exemplary embodiment of the invention.
Figure 12:
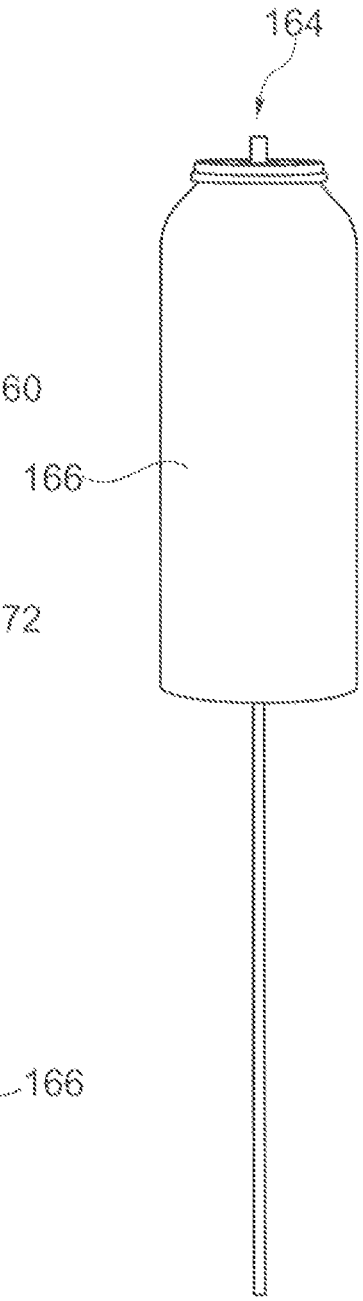
Figure 13:
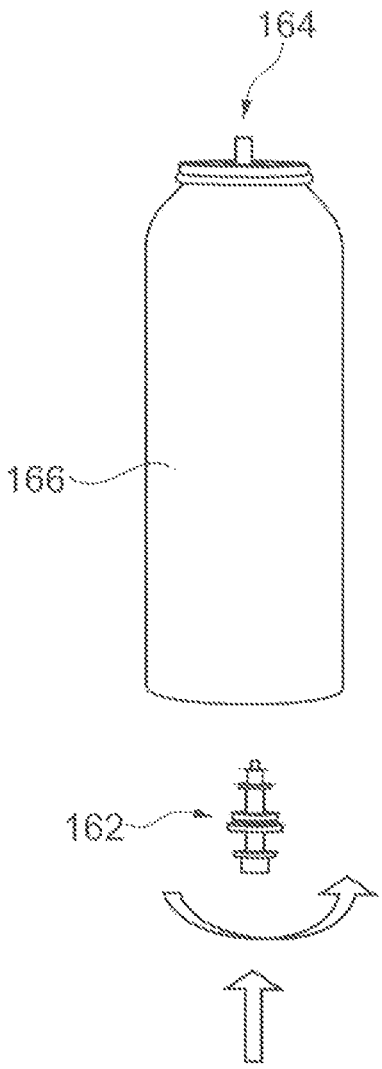

FIG. 11 to FIG. 13 show different views during a method for manufacturing a refillable dispenser can 104 with separated receiving volumes of the active substance and the pressure medium, according to an exemplary embodiment of the present invention.

Referring to FIG. 11, the distributor pipe 172 with the pre-mounted outlet valve 164 is inserted in a receiving volume of the can housing 166. According to FIG. 11, the distributor pipe 172 is open at the bottom and circumferentially wrapped by the folded bag 160, such that the bag 160 with the distributor pipe 172 is inserted in the can housing 166. FIG. 12 shows a result of the mounting procedure according to FIG. 11. Referring to FIG. 13, at the bottom side of the can housing 166, the refill valve 162 is attached, for example screwed. The refill valve 162 may be plugged on a bottom side of the distributor pipe 172.

Into the volume 168 which is not illustrated in FIG. 11 to FIG. 13, in particular by the outlet valve 164 and the distributor pipe 172, the pressure gas is filled once. In the state of the distributor pipe 172 attached to the refill valve 162, the active substance can be filled through the refill valve 162 which transfers the bag 160 from the folded state according to FIG. 11 to an unfolded expanded state (see FIG. 9). Around the bag 160, the compressed pressure medium exerts a pressure on the active substance in the bag 160. This pressure is used when discharging the active substance out of the outlet valve 164.

Supplementary, it is to be noted that "comprising" does not exclude other elements or steps and "a" or "an" does not exclude a plurality. Furthermore, it is noted that features or steps which are described with reference to one of the above embodiments may also be used in combination with other features or steps of other above-described embodiments. Reference signs in the claims are not to be construed as limitation.

The invention claimed is:

1. Refillable dispenser can for discharging an active substance, wherein the dispenser can comprises:

a deformable bag for receiving the active substance;

a refill valve which is connected with the bag for connecting with a refill station for refilling the bag with the active substance;

an outlet valve which is connected with the bag for discharging the active substance out of the bag in a user-defined manner; and a distributor pipe at least in portions in the bag, which is at least in portions arranged between the refill valve and the outlet valve, and comprises at least one sidewall opening for forming at least one passage for the active substance between an interior of the distributor pipe and a receiving volume of the bag.

2. Dispenser can according to claim 1, wherein the refill valve is arranged at a bottom side of the dispenser can.

3. Dispenser can according to claim 1, wherein the outlet valve is arranged at a top side of the dispenser can.

4. Dispenser can according to claim 1, wherein the refill valve and/or the outlet valve is or are fluid-tightly attached to the bag.

5. Dispenser can according to claim 1, wherein the bag is elastically deformable or unfoldable.

6. Dispenser can according to claim 1, comprising an outlet unit on the outlet valve.

7. Dispenser can according to claim 1, wherein the distributor pipe comprises a plurality of sidewall openings which are arranged axially or radially offset with respect to each other.

8. Dispenser can according to claim 1, comprising at least one of the following features:

wherein the distributor pipe comprises a telescopic mechanism for enabling a length compensation of the distributor pipe;

wherein the distributor pipe is loosely plugged or firmly connected on the refill valve;

wherein the distributor pipe is firmly connected or loosely plugged on the outlet valve.

9. Refill arrangement comprising:

a refill station with a receiving device for receiving a dispenser can which is to be refilled with an active substance, and with a control unit for controlling the refill of the dispenser can with the active substance; and a dispenser can which is attachable or attached at the receiving device, according to claim 1.

10. Refill arrangement according to claim 9, comprising an active substance container which contains the active substance and which is coupled or couplable with the receiving device, for providing the active substance for refilling the dispenser can.

11. Method for operating a refill station, wherein the method comprises:

receiving a refill valve of a dispenser can which is to be refilled with an active substance, according to claim 1, at a receiving device of the refill station; and controlling the refill of the dispenser can with the active substance by a control unit of the refill station.

12. Method according to claim 11, wherein, by refilling the active substance, a pressure medium is pressurized in a closed volume between the bag and a rigid can housing of the dispenser can.

13. Dispenser can according to claim 1, comprising a rigid can housing which encloses the bag, with respect to which the refill valve and the outlet valve are exposed.

14. Dispenser can according to claim 13, wherein the outlet valve is configured for filling a pressure medium between the bag and the can housing.

15. Dispenser can according to claim 13, comprising a pressure medium in a volume between the bag and the can housing.

16. Dispenser can according to claim 13, wherein a volume between the bag and the can housing is hermetically closed.

17. Dispenser can according to claim 13, wherein the can housing is curved at its bottom side.

18. Dispenser can according to claim 15, wherein an active substance in the bag and the pressure medium between the bag and the can housing are pressure-coupled with each other through the bag, without the active substance and the pressure medium being in direct contact with each other.

19. Dispenser can according to claim 15, wherein leaking through the refill valve or through the outlet valve is made impossible for the pressure medium.

* * * * *